United States Patent [19]

Jost

[11] Patent Number: 4,779,366

[45] Date of Patent: Oct. 25, 1988

[54] PICTURE-HOLDING DEVICE

[75] Inventor: Jochen Jost, Essen, Fed. Rep. of Germany

[73] Assignee: Filmosto-Projektion Johannes Jost GmbH & Co., Essen, Fed. Rep. of Germany

[21] Appl. No.: 884,383

[22] Filed: Jul. 11, 1986

[30] Foreign Application Priority Data

Jul. 12, 1985 [DE] Fed. Rep. of Germany ..... 3524864

[51] Int. Cl.[4] ..... G09F 3/18

[52] U.S. Cl. ..... 40/653; 40/152; 40/154; 40/661; 40/641

[58] Field of Search ..... 40/10, 16, 10 D, 152, 40/154, 124, 124.2, 156, 17

[56] References Cited

U.S. PATENT DOCUMENTS

| | | | |
|---|---|---|---|
| 1,197,065 | 9/1916 | Sand | 40/17 |
| 1,338,441 | 4/1920 | Haley | 40/154 |
| 1,444,358 | 2/1923 | Rand | 40/16 |
| 1,762,083 | 6/1930 | Singer | 40/154 |
| 1,904,318 | 4/1933 | Lehere | 40/154 |
| 2,296,596 | 9/1942 | Brown | 40/154 |
| 2,336,198 | 12/1943 | Sparling | 40/154 |
| 2,741,046 | 4/1956 | Kroslak | 40/209 |
| 3,654,719 | 4/1972 | Rochelt | 40/152 |
| 4,261,124 | 4/1981 | Carter | 40/156 X |
| 4,518,080 | 5/1985 | Ohlson | 40/16 |
| 4,536,979 | 8/1985 | Parkinson | 40/124.2 |

FOREIGN PATENT DOCUMENTS

| | | | |
|---|---|---|---|
| 492760 | 5/1953 | Canada | 40/17 |
| 1964352 | 3/1967 | Fed. Rep. of Germany . | |
| 2331364 | 1/1975 | Fed. Rep. of Germany . | |
| 8515057 | 7/1985 | Fed. Rep. of Germany . | |
| 8510961 | 8/1985 | Fed. Rep. of Germany . | |
| 234634 | 6/1925 | United Kingdom | 40/154 |

*Primary Examiner*—Gene Mancene
*Assistant Examiner*—Wenceslao J. Contreras
*Attorney, Agent, or Firm*—Collard, Roe & Galgano

[57] ABSTRACT

The holder serves for fixing sheet-like picture material between a back wall (1) and a transparent front pane, which together with the picture material can be exchanged towards the front side. The back wall (1) is designed as one piece with a frame (2) extending around the inserted picture material and the front pane and projecting towards the face side. Frame segments disposed on opposing sides (3, 4) of the frame each support at least one holding attachment (5, 6) and each are cut free by a through-extending opening (12, 13) disposed adjacent the holding attachment, wherein in each case one of said openings is aligned with a holding attachment, exposing an area in the back wall (1) which is larger than the parallel projection of the projecting holding attachment. One (13) of the through-extending openings is shaped in a way such that it can be penetrated by the user with the end of a finger in order to lift out the picture material and front pane for exchanging the picture. The through-extending opening (13) is extended by slots to an extent such that the frame segment (4) disposed adjacent to said opening can be readily deformed for exchanging the picture and is capable of elastically returning to its initial position.

13 Claims, 1 Drawing Sheet

PICTURE-HOLDING DEVICE

BACKGROUND OF THE INVENTION

1. Field of the Invention

The invention generally relates to a holding device for sheet-like picture material, and in particular to a holder which can be produced in one piece by injection molding from elastically deformable plastic material, and in which holder sheet-like picture material such as, for example, a photographic picture, can be exchangeably received and made visible through a front pane.

2. State of the Art

With a known picture frame, four straight side profiles of the frame each are individually rigidly joined with the back wall by glueing. Each side of the frame has a holding attachment in the form of a rib overlapping the edge of the front pane. Within the corner zone, the adjacent sides of the frame join each other in complementary butt joints, where said sides are loosely resting on each other. The joint between each individual side of the frame and the back wall is formed by a tilting edge, around which edge each side of the frame can be swiveled to an extent permitting removal of the front pane. The butt joints in the corners of said known frame design can be completely locked only if said frame is manufactured with very high accuracy; especially in the presence of manufacturing tolerances or material fatigue, the butt joints in the corner zones may be displaced, which, on the one hand, interferes with the visual appearance of the total frame and, on the other hand, impairs the holding function of the short holding or supporting ribs. The rib-like holding attachments have to be manufactured separately and exactly joined by glueing with the back wall. A one-piece manufacture of the known picture frame by injection molding is not possible on account of the ribs projecting beyond the back wall.

DESCRIPTION OF THE INVENTION

The objective of the invention is to provide a holder serving as a picture frame that can be manufactured in a particularly simple manner as one single part as an injection-molded part.

Another objective of the invention is to design the holder in such a way that it supports the sheet-like picture material with complete areal support on one plane of the picture, permitting simple handling and exchange of the picture material. The outer form and visual appearance of the holder are to be preserved even after a longer period of use and several picture exchanges.

The holding device according to the invention has a holder produced in one piece by injection molding from elastically deformable plastic material, said holder forming a flat trough for receiving sheet-like picture material and comprising a transparent front pane. Said holder has a substantially planeback wall on which the picture material finds substantially complete support across its entire area. A frame extending all around is molded integrally with the back wall and projects from the back wall in the direction of the viewer, i.e., towards the front or face side, in order to define jointly with the back wall the trough for receiving the sheet-like picture material and the transparent front pane. At least two holding attachments, which are spaced from each other, are provided on the front edge of the frame extending all around, said holding attachments projecting in the receiving trough and extending substantially parallel to the plane of the back wall with a spacing from said wall. The holding attachments overlap the front pane and fix said pane in the receiving trough in such a way that the picture material is clamped between the front pane and the back wall. In the back wall, at least two through-extending openings are provided, which each abut segments of the frame extending all around. Said through-extending openings each are aligned with at least one holding attachment and expose a cross section of the opening in the back wall, said cross section being larger than the overlapping of an associated holding attachment, i.e., larger than the parallel projection of the associated holding attachment on the back wall. At least one of the through-extending openings extends adjacent the associated segment of the frame with a length such that the associated segment of the frame can be resiliently deflected outwardly with widening of the through-extending opening to an extent such that the holding attachment fastened on the associated segment of the frame is laterally released from the locking engagement on top of the front pane, releasing said front pane for removal.

The through-extending openings within the zone of the bottom wall that is close to the edge permit the adjacent segment of the frame to be lifted from its support on the circumferential edges of the picture material and front pane like a chord of an arc, whereby the elastically deformable plastic material of the adjacent segment of the frame expands accordingly. In this way, the adjacent holding attachment is displaced or shifted from the edge of the front pane, so that the latter is exposed for removal. As soon as the outwardly arched segment of the frame is released, resiliency causes it to return to the initial position because said segment is kept under tension by the adjacent segments of the frame, or by the two adjacent sides of the frame, if need be. The back wall assures a practically complete and plane support of the picture material. Yet the holder according to the invention may be produced without any problems by injection molding in a two-part molding tool, and then removed or ejected from the mold. The through-extending openings in the back wall make the bottom sides of the projecting holding attachments accessible to suitable projections of molding dies, which, during the injection molding of the holder, are admitted from the rear side. In this connection, it is important that the through-extending openings conform to at least the parallel projection of the holding attachments—which are aligned with said holding attachments—with respect to position, shape and size. Preferably, the through-extending openings are larger than the overlappings of the holding attachments, i.e., larger than their parallel projection. On completion of the injection molding process, the mold can be opened without any problems and the injection-molded holder can be readily removed from the two halves of the mold because the finished molded part has no overhanging parts that could interfere with the removal from the mold. The finished molded part is closed over the entire circumference, so that its shape, which is fixed by the manufacturing or molding step, is reliably preserved or restored on deformation even if the picture material is repeatedly exchanged or the through-extending opening spread apart.

For producing the holder according to the invention, various materials are suitable, for example polystyrenes, polyester resins, polypropylene, and similar plastics capable of elastic deformation after curing. Polystyrenes have properties which are especially favorable for the purposes of the invention.

When the holder of the invention is designed as a rectangular picture frame, it is characterized by the additional features that inwardly projecting holding attachments are molded on two opposing sides of the frame, and that the back wall is exposed by cuts provided as slots in said sides of the frame, said slots directly adjoining the associated segments of the frame and extending parallel to said segments. The through-extending openings may be extended by narrower slots extending parallel to the associated segments of the frame. Preferably, the slots extend only over a partial or part of the length of the adjacent sides of the frame in order to stabilize the frame in the corner zones by connecting it with the back wall and to increase the resiliency or returning forces of the one-piece frame accordingly. However, on the other hand, it is possible to extend slots beyond the corners of the frame in order to create sufficient elastic deformation lift or stroke of the frame segment especially if the holding attachments are close to the corners.

Another feature of the invention permits exchanging the picture in a particularly simple manner, said feature being that at least one of the through-extending openings is designed in such a way with respect to its size and shape that the user is able to extend through said opening the end of a finger: when arching outwardly the segment of the frame which is extending across the through-extending opening, said opening may be penetrated from the backside of the frame with the end of a finger and the sheet-like picture material together with the front pane may be lifted from the receiving trough. Preferably, the through-extending opening is limited at its side averted from the adjacent segment of the frame in the way of a divided circle.

In spite of easy elastic deflectability of the segment of the frame that is cut free, the stability of the total frame can be increased by designing the frame in such a way that it projects rearwardly beyond the back wall in the form of a collar. In such an embodiment, sufficient space remains between the back wall and the rearward plane of limitation of the frame in order to mount on the back wall a pot-shaped suspending device, preferably by molding.

Preferably, the depth of the receiving trough defined by the frame is larger than the joint thickness of the picture material placed in the frame and the front pane. This permits using simple, cut panes of glass as the front pane. The sharp cutting edges of such front panes are enclosed and protected by the edge of the holder of the invention, said edge extending around said pane, and practically invisible if suitably fitted. The hazard of injury caused by the outer edges of the cut glass, which edges are relatively sharp in most cases, has been practically eliminated by the why in which the frame overlaps the edges without any costly grinding of the edges.

BRIEF DESCRIPTION OF THE DRAWINGS

Additional advantages of the invention are explained in the following description of the embodiment shown in the drawing, in which.

DETAILED DESCRIPTION OF THE FIGURES

Figure 2:
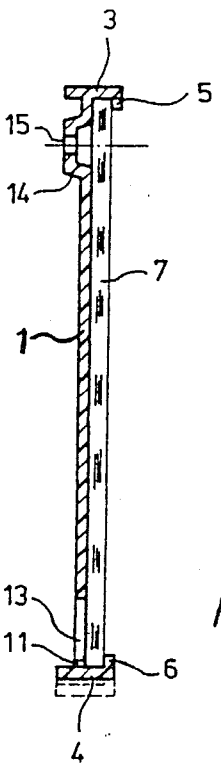
FIG. 2 is a sectional view showing a cut through the holder along line II—II in FIG. 1, with the front pane mounted in the holder.

The holder shown in the figures has a square frame 2 extending all around and forming one piece with a back wall 1, said frame 2 projecting beyond the plane back wall 1 in the form of a collar both on the front and back sides. On the front edge of the frame of the two opposing frame sides 3 and 4, the holding attachments 5 and 6 are provided in the form of lashing-type attachments molded on said sides, said holding attachments projecting inwardly in a receiving trough with a spacing from the plane of the bottom wall 1; the picture material and a transparent front pane 7 can be placed or inserted in said receiving trough.

Figure 1:
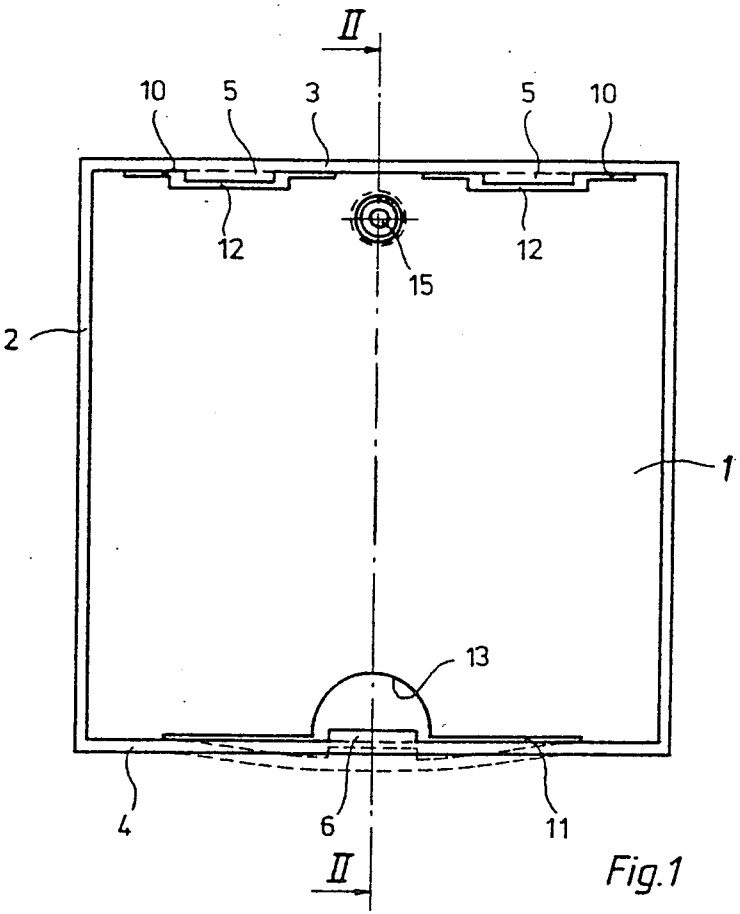
FIG. 1 shows a front view of the holder without the front pane and picture material.

Within the zone of the holding attachments 5 and 6, the slots 10 and 11 are provided, in each case extending along the frame sides 3 and 4. In the embodiment shown in the drawing, each of said slots changes into an expanded or widened recess 12 and 13, respectively. For reasons of injection molding technology, each recess 12 and 13 has a size at least conforming to the projection area of the holding attachments. The areas cut free in the bottom plate 1 by the slots and the recesses 10 . . . 13 permit an elastic deformation of the adjacent frame segments supporting at least one holding attachment 5 and 6, respectively, to an extent such that the holding attachments are displaced outwardly from the position overlapping the edge of the pane, so that the front pane 7 can be lifted from the trough of the frame. Said elastic deformation of the frame segment supporting the holding attachment 6 is shown in FIG. 1 by the dashed line. As soon as the associated segment of the frame is released, it is elastically returned to its straight original or initial position which, in FIG. 1, is shown by the fully drawn lines; in said initial position, the associated holding attachment is capable of gripping over the picture material with the front pane in a form-fitting manner, clamping said material and the pane against the back wall 1.

FIG. 1 shows that the through-extending opening 13 is limited or defined in the form of a semi-circle. Its cross section is sufficiently large to permit the user to penetrate said opening with the end of a finger. When the associated segment of the frame is in the arched state, the sheet-like picture material and the front pane 7 can be lifted from the backside of the frame with the end of the finger. As soon as the front pane 7 and the picture material have been lifted from the receiving trough, they can be pulled out from between the back wall 1 and the oppositely disposed holding attachments 5. Thus the frame segments may be relatively rigid within the zone of the slots and openings 10 and 12. However, on the other hand, a through-extending opening 12 is provided in alignment with the projecting holding attachments 5, said opening having a size large enough to permit easy removal of the holder from a two-part mold on completion of the injection molding step.

A suspension pot 14 provided with a bore 15 projects into the trough formed on the backside of the back wall 1, said trough being defined by the strip-like sides of the frame. With the help of a screw penetrating the bore 15 in the suspension top 14, the holder shown in the drawing can be screwed to a suitable supporting wall. The segments of the frame that are cut free can be laterally arched and the associated slots 10 or 11 widened and the associated holding attachments 5 and 6 lifted out without any problems even if the holder is rigidly mounted, for example on the wall of a room.

The invention is not limited to the embodiment which is described in the foregoing and shown in the drawing, but covers all modifications within the scope of the claims attached hereto.

I claim:

1. A holder formed of plastic material and having a flat trough for receiving sheet-like picture material and a transparent front pane, said holder comprising:

a substantially planar back wall for supporting the picture material in a substantially complete areal manner;

framing means having a circumferential collar generally perpendicular to said back wall and integrally molded with said back wall and projecting from said back wall towards a front side in order to jointly define with said back wall said receiving through;

at least two holding attachments on portions of said collar spaced from each other and projecting into said receiving trough and spaced from the plane defined by the back wall for fixing said front pane in the trough in a way such that the picture material is clamped between said front pane and said back wall, said holding attachments having a bottom side and a top side; and at least two through extending openings provided in said back wall, said openings each being aligned with at least one holding attachment and being at least as large as the bottom side of the at least one associated holding attachment, so that the bottom side of each holding attachment is accessible to a molding tool by way of the associated through extending opening;

wherein at least one of the through extending openings extends abutting an adjacent segment of one portion of said collar of the framing means over a length such that the associated segment portion of the collar with the at least one holding attachment is capable of lateral resilient deflection to an extent that the associated holding attachment is displaced sideways from its holding position on top of the front pane thereby releasing the same.

2. The holder of claim 1 in the form of a square picture frame, said holder having four frame sides, wherein projecting holding attachments are provided on two opposing sides of the frame, said holding attachments projecting into the receiving trough, and wherein the back wall is cut free from said sides of the frame by slots directly adjacent the associated sides of the frame and extending parallel to said sides of the frame.

3. The holder of claim 1, wherein the through extending openings are extended by narrower slots extending parallel to the associated sides of the frame.

4. The holder of claim 1, wherein the through extending opening sized and shaped for penetration by the end of a finger is shaped at its side averted from the adjacent segment of the frame in the form of a semicircle.

5. The holder of claim 1, wherein the frame projects rearwardly beyond the back wall in the form of a collar.

6. The holder of claim 5, wherein the back wall is provided with a pot-shaped suspension device.

7. The holder of claim 1, wherein the back wall and the frame with the holding attachments are formed as one piece in the form of an injection-molded part.

8. The holder of claim 1, wherein the depth of the receiving trough defined by the frame is greater than the combined thickness of the picture material and transparent front pane, so that the picture material and the front pane may be arranged flush in the receiving trough.

9. A picture holding device consisting of a one-piece molded plastic part and a transparent front pane, said plastic molded part comprising:

a substantially closed bottom wall and a frame enclosing said bottom wall all around, said frame having four sides arranged in a rectangular configuration, wherein the sides of the frame project at right angles from the bottom wall and have a top edge disposed on a plane parallel to the bottom wall;

at least two holding attachments provided on said edge, said holding attachments engaging a receiving trough defined by the frame and substantially closed on the bottom side by said bottom wall;

slots provided in the bottom wall adjacent segments of the frame sides supporting holding attachments so as to permit the associated segment of the frame to expanded sideways; and widened through extending openings provided in said slots at points aligned with each holding attachment, said openings having a size at least as large as the projection of the part of the adjacent holding attachment, so that during the manufacture of the molded body, each holding attachment is accessible to a molding die, said molding die being inserted through the extending opening in the bottom wall.

10. The holding device of claim 9, wherein at least one of the through extending openings has a size and shape such that it can be penetrated by the user with the end of a finger in order to push the front pane and picture material from the receiving trough.

11. The holder of claim 10, wherein said at least one of the through extending openings is shaped at its side averted from the adjacent side of the frame is the form of a semicircle.

12. The holder of claim 11, wherein at least one of the holding attachments and an associated through extending opening is provided within the region of each of two opposing sides of the frame, and wherein only one of said through extending openings has a size suitable for being penetrated by the end of a finger.

13. A picture-holding device comprising:

a one-piece molded plastic frame, said frame having a first and second pair of opposed sides, said first pair of opposed sides being rigid and having a bottom wall extending inwardly therefrom, each of said sides of said second pair of opposed sides having a least one holding attachment extending inwardly therefrom in a plane generally parallel to said inwardly extending bottom wall and spaced a predetermined distance therefrom, at least one of said sides of said second pair of opposed sides resiliently movable in a direction outwardly of said frame; and a rigid transparent front pane of a predetermined size corresponding to said one-piece molded plastic frame and capable of being slidably inserted within said frame by being slid along said inwardly extending bottom wall and under one of said holding attachments, said predetermined size of said transparent front pane requiring the outward deflection of said holding attachment associated with said at least one resiliently movable side in said plane generally parallel to said inwardly extending bottom wall for insertion of said rigid front pane over said holding attachment and onto said bottom wall, whereby said holding attachment on said at least one resiliently moveable side upon returning to its position prior to said outward deflection, thereby captures said rigid front pane within said frame between said bottom wall and said holding attachments.

* * * * *